US007330130B2

(12) United States Patent
Bolotin et al.

(10) Patent No.: US 7,330,130 B2
(45) Date of Patent: Feb. 12, 2008

(54) APPARATUS FOR DISPLAYING THE REMAINING TIME OF A TRAFFIC LIGHT

(75) Inventors: Michael I. Bolotin, Kirkland, WA (US); Lev M. Bolotin, 9306 NE. 125th St., Kirkland, WA (US) 98034; Jana Bolotin, Kirkland, WA (US)

(73) Assignee: Lev M. Bolotin, Kirkland, WA (US)

( * ) Notice: Subject to any disclaimer, the term of this patent is extended or adjusted under 35 U.S.C. 154(b) by 0 days.

(21) Appl. No.: 11/340,896

(22) Filed: Jan. 27, 2006

(65) Prior Publication Data

US 2007/0176791 A1 Aug. 2, 2007

(51) Int. Cl.
*G08G 1/096* (2006.01)

(52) U.S. Cl. ..... 340/929; 340/923; 340/925; 340/907; 340/944

(58) Field of Classification Search ..... 340/929, 340/925, 907, 944, 923
See application file for complete search history.

(56) References Cited

U.S. PATENT DOCUMENTS 5,726,648 A * 3/1998 Soon ..... 340/929
6,268,805 B1 7/2001 Simon
6,310,562 B1 10/2001 Safronov et al.
6,331,824 B1 * 12/2001 Firestone ..... 340/929
2002/0005790 A1 * 1/2002 Georgalis ..... 340/929
2003/0048201 A1 * 3/2003 Weiss et al. ..... 340/929
2004/0189491 A1 * 9/2004 Aydin ..... 340/925

FOREIGN PATENT DOCUMENTS

RU 2080657 5/1997
RU 2175781 11/2001
RU 2224294 2/2004

* cited by examiner

*Primary Examiner*—Tai Nguyen
(74) *Attorney, Agent, or Firm*—Lev M. Bolotin

(57) ABSTRACT

A traffic light indicator warns the motorists and pedestrians of the remaining before the traffic light changes through a visual and pictorial display defined within the light indicators of the traffic light structure. One or more light indicators are programmed to display a selected pattern of diminishing light portions within the area of the light selected indicators, gradually expanding a no-light zone with the passage of seconds remaining before the traffic light changes.

19 Claims, 2 Drawing Sheets

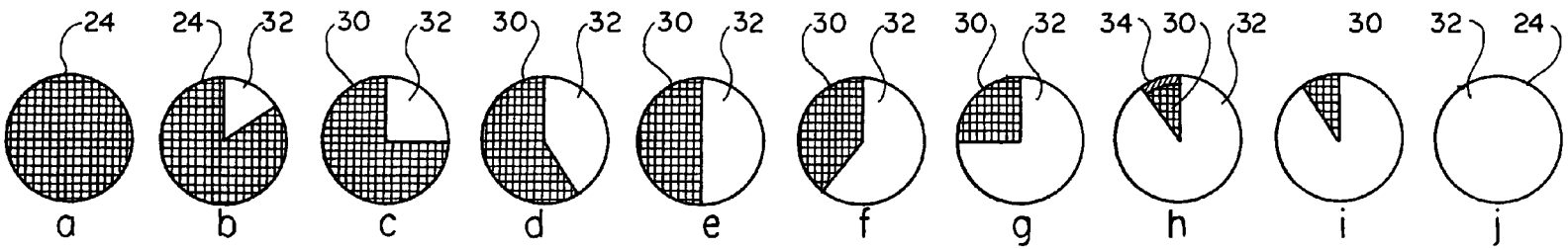
FIG. 1
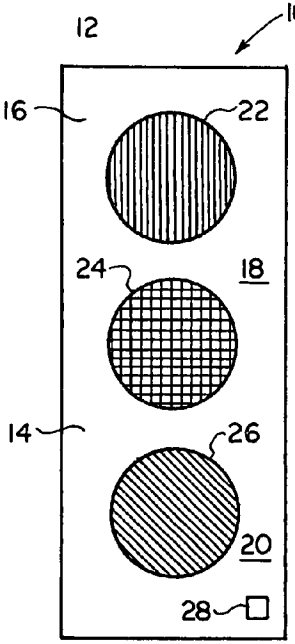
FIG. 2
FIG. 3
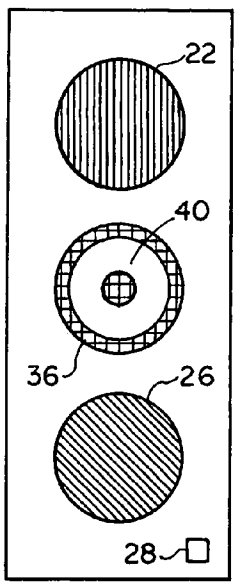
FIG. 4
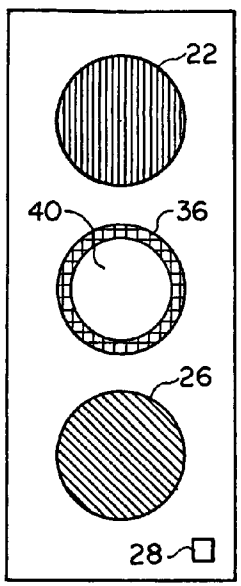
FIG. 5
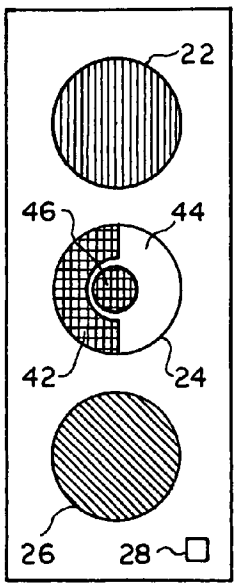
FIG. 6

APPARATUS FOR DISPLAYING THE REMAINING TIME OF A TRAFFIC LIGHT

BACKGROUND OF THE INVENTION

The present invention relates to an electronic traffic light, which is adapted to control vehicular traffic and pedestrian flow through an intersection.

As the traffic load increases, the management of the traffic gains greater importance for traffic engineers and city planners. Traffic lights (traffic signal transmitters) are universally used for the management of traffic. Red, yellow and green lights bear the same meaning throughout the world for all people. The traffic engineers carefully study the traffic flow through intersections, arterial streets and small roads, all in an attempt to make the traffic flow smoothly, without much delay and idling of the engines. Conventional traffic lights are programmed to allow one indicator to only flash for a short period of time before the other illuminates.

Normally, the yellow indicator illuminates only a few seconds before the red indicator illuminates. The motorists and pedestrians do not exactly know the remaining time before the red indicator illuminates. Consequently, the drivers may run a red light because there is no time to respond to this quick change. Sometimes, one vehicle collides with another vehicle in the front which has stopped abruptly when the yellow light started flashing. The resulting accident causes property damage and disrupts the traffic flow through the intersection for a long period of time.

The industry has attempted to solve the problem by offering electronic devices, which work in association with conventional traffic light indicators by counting down the time remaining before the light change. For instance, U.S. Pat. No. 6,268,805 (Simon) discloses a count-down indicator with a digital display that displays (i.e., counts down) the remaining time in seconds until the next signal change occurs. The digital display matches the color of the digits being displayed to that of the illumined light of the signal assembly. A flashing caution light is attached to the digital display and it flashes whenever there is potential that the remaining time can suddenly change in a manner that violates the normal count-down sequence.

While the device of the Simon patent may work satisfactory in many instances, it has certain disadvantages, which may be demonstrated by application to on-demand types of traffic lights that include a normal duty cycle but are able to override the normal duty cycle based on the immediate traffic flow. Such lights are designed to detect the condition of traffic at a particular intersection and decrease the normal cycle of a light indicator that has been programmed by the traffic engineers. For instance if there are thirty seconds of green time remaining and there is no traffic passing through the intersection while cars are waiting at a red light to cross in a perpendicular direction, such on-demand traffic signals will detect this condition and reduce the thirty second normal countdown to only a few seconds before changing. A countdown indicator that is operationally connected to the programmed cycle of the traffic light could mislead a motorist if the light changes without warning, while the countdown indicator still shows in a numerical fashion several seconds of remaining green time.

Therefore, there is room for an improved traffic light device that is programmed to visually and pictorially display the time remaining before the light changes to thereby increase the convenience of the motorists and pedestrians, as well as the traffic safety.

SUMMARY OF THE INVENTION

The general purpose of the present invention, which will be described subsequently in greater detail, is to provide a new traffic light device, which displays the time remaining before the indicator light changes on the light fixture proper.

It is another object of the present invention to provide a traffic light device, which pictorially displays the time remaining before the indicator light changes on the light fixture proper.

These and other objects of the present invention are achieved through a provision of a traffic light device, which comprises a signal structure having a red stop light indicator, a green passage light indicator, and a yellow caution light indicator. The light indicators may be circular or rectangular. The device has a count down indicator means coupled to at least one light indicator for pictorially displaying through a diminishing illumination of portions of said at least one light indicator the time remaining until traffic light changes.

A control means with a microprocessor allows selection of a desired pattern, according to which the selected light indicator will display the remaining time. The selected pattern may include segments of the circle area of the indicator light, with the no-light segments gradually increasing in a clockwise or counterclockwise direction. The pattern may be also selected by forming a normally illuminated center portion and an outer band, which gradually expands non-illuminated portions in a radial fashion towards the center as the remaining time decreases. The pattern may also include a two-part outer band, with one part displaying the color corresponding to the then current cycle, while the second part is programmed to display a gradually diminishing light pattern. The pattern may further include a normally illuminated outer band with the central portion that demonstrates progressively extinguished-light areas, expanding in linear (for example vertical or horizontal) directions.

When the traffic light indicators are formed rectangular, the extinguishing-light pattern may include a normally illuminated rectangular border with the central portion demonstrating progressively expanding no-light areas moving in a horizontal or vertical direction.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 1*a* through 1*j* are diagrammatic views illustrating countdown sequence of illuminating a circular light indicator of a traffic light device.

FIG. 2 is a schematic view illustrating a traffic light device in accordance with the first embodiment of the present invention.

FIG. 3 is a schematic view illustrating a traffic light device with the illumination pattern expanding no-light zones from outside towards the center of a circle.

FIG. 4 is a schematic view illustrating the traffic light device with the illumination pattern of the second embodiment showing the next stage of the illumination pattern.

FIG. 5 is a schematic view illustrating the traffic light device with the illumination pattern of the second embodiment showing the next stage of the illumination pattern.

FIG. 6 is a schematic view illustrating a traffic light device with the illumination pattern in accordance with the third embodiment of the present invention.

DETAILED DESCRIPTION OF THE PREFERRED EMBODIMENTS

Figure 7:
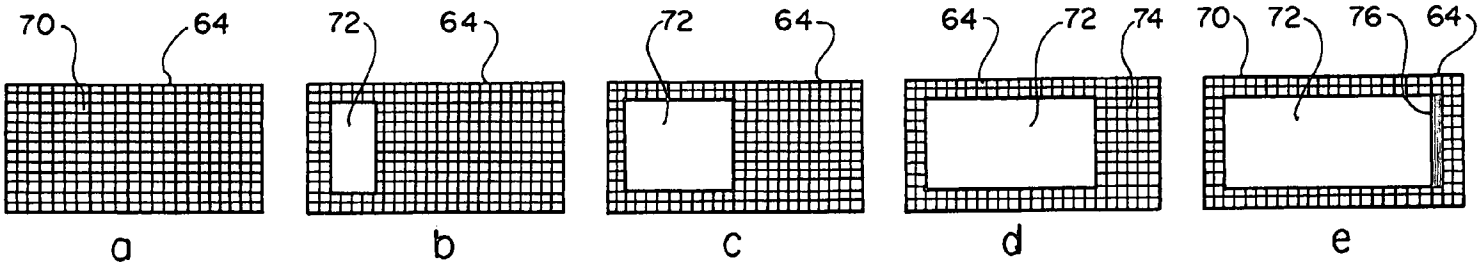
FIGS. 7*a* through 7*e* are diagrammatic views illustrating countdown sequence of illuminating a rectangular light indicator of a traffic light device.

With reference now to the drawings, a new traffic light device embodying the principles and concepts of the present invention will be described.

The first embodiment of the traffic light device of the present invention is schematically illustrated in FIG. 2 and is designated by numeral 10. The traffic light device 10 has a vertically-oriented and parallelepiped-shaped housing 12 with a rectangular-shaped housing front 14. A horizontally-extending upper through opening is formed in an upper part 16 of the housing 12. A horizontally-extending middle through opening is formed in a middle part 18 of the housing 12, and a horizontally-extending lower through opening is formed in a lower part 20 of the housing 12. A has a red light indicator 12 located in the upper portion of the device, a yellow light 14 positioned below the red light 12 and a green light 16 positioned in the lower part of the device 10.

The device 10 comprises a circular-shaped "stop" indicator light 22 that is disposed in the upper through opening of the upper part 16. The "stop" indicator light 22 is preferably red since red is the international signal for "stop," but may be any other accepted color without departing in any way from the spirit of the present invention. The device 10 also comprises a circular-shaped "caution" indicator light 24, which is disposed in the middle through opening of the intermediate part 18. The "caution" indicator light 24 is preferably yellow, since amber is the international signal for "caution," but may be any other accepted color without departing in any way from the spirit of the present invention. The device 10 further comprises a "go" indicator light 26 located in the through opening of the lower part 20. The "go" indicator light 26 is preferably green since green is the international signal for "go," but may be any other accepted color without departing in any way from the spirit of the present invention.

The indicator lights 22, 24, and 26 may be filament, halogen or LED (Light Emitting Diode) lamps. The LED lights may have certain advantages over other types of lamps as consuming less energy and capable of easy programming, the benefits of which will be explained in more detail hereinafter.

A control means, or control circuitry 28 is mounted in the housing 12. The control circuitry 28 is operationally coupled to the indicators 22, 24 and 26. The control circuitry comprises a timer (not shown) and is adapted to control time between a red light changing to a green light and a green light changing to a yellow light within the device 10. The control means 28 is preferably a microprocessor.

In FIG. 2, the circular light indicators 22, 24, and 26 are schematically shown as if fully illuminated. Referring to FIG. 1, the manner of signaling the remaining time using the embodiment of FIG. 2 is diagrammatically illustrated. As an example, FIG. 1 uses the yellow light indicator 24. When the indicator 24 is just switched on, the entire area of the circle 24 has the yellow color, as can be seen in FIG. 1*a*. As the time remaining for the indicator 24 decreases, the yellow-illuminated area diminishes, with a discrete sector 32 becoming non-illuminated, as shown in FIG. 1*b*. The non-illuminated sector 32 progressively expands, as shown in FIGS. 1*c* through 1*g*, with about one-quarter of the circle area remaining illuminated. Finally, when the yellow light cycle finished, the circle of the indicator 24 is no longer illuminated, as shown in FIG. 1*j*.

FIGS. 1*h* and 1*i* illustrate alternative methods of displaying a fraction of remaining time before the light change takes place. In FIG. 1*h*, a small warning red arc 34 is formed along the circumferential portion of the circle, with a corresponding sector 30 shown in yellow light. The red arc 34 provides an additional warning means for motorists and pedestrians that the red light is about to be switched on. The remainder of the circle is non-illuminated.

FIG. 1*i* shows a yellow sector 30 without the red arc, with the remaining area of the circle being non-illuminated. The cycle ends when the entire area 32 of the circle is non-illuminated, as shown in FIG. 1*j*. Such gradually-diminishing-circle illumination provides a vividly pictorial means for the public traversing an intersection of the remaining time before signal light changes. Of course, clock-wise or counterclockwise movement of the expanding "no-light" area can be used. The control means 28 allows the traffic light itself to visually and pictorially indicate the remaining time before the light changes. No additional devices or mechanisms are necessary.

Turning now to FIG. 3, an alternative embodiment of the programmable pattern of the diminishing illumination indicator light 10 is illustrated in an example of the "caution" light, or yellow light. In this embodiment, the cycle starts with the same pattern as that shown in FIG. 2. At the next stage, a pattern is defined by a normally-illuminated outer band 36 and a smaller diameter inner circle 38, which are illuminated yellow. A gradually increasing band of "no-light" 40 is sandwiched between the light band 36 and the zone 38. In the illustration of FIG. 3, the band 40 is visible between the zones 36 and 38, which would indicate to the public that the "caution" time is decreasing. As the seconds pass, the band 40 expands in a radial direction, from the outside of the circle towards the center, as shown in FIGS. 4 and 5. The outer band 36 stays illuminated yellow at all times. The view shown in FIG. 5, where the non-illuminated center occupies the majority of the circle area will signal to the public that the yellow light cycle is finished and the red light will switch on momentarily.

FIG. 6 illustrates still another example of the programmable light pattern produced in the yellow light indicator. In this example, the controllable pattern makes the light indicator change colors, starting from a full yellow circle, as shown in FIG. 2 and gradually diminishing yellow illuminated portion 42. The extinguishing of illumination in the zone 42 may be programmed to follow a clockwise or counterclockwise direction. The area of diminishing yellow light is gradually occupied by the next color in the cycle, in this example red area 44. The center of the circle 46 remains yellow while the wide outer band 42 changes color.

Alternatively, the programmed patter may include a half-circle portion 42 that has a constant color corresponding to the then current cycle in the traffic management structure 10. The portion 44 is programmed to gradually diminish the illuminated areas until the half-circle portion 44 becomes blank (non-illuminated) that is not having a color corresponding to the traffic light cycle. Of course, the portions 42, 44 need not be half-circles and may indeed be proportionally different if desired.

Figure 8:
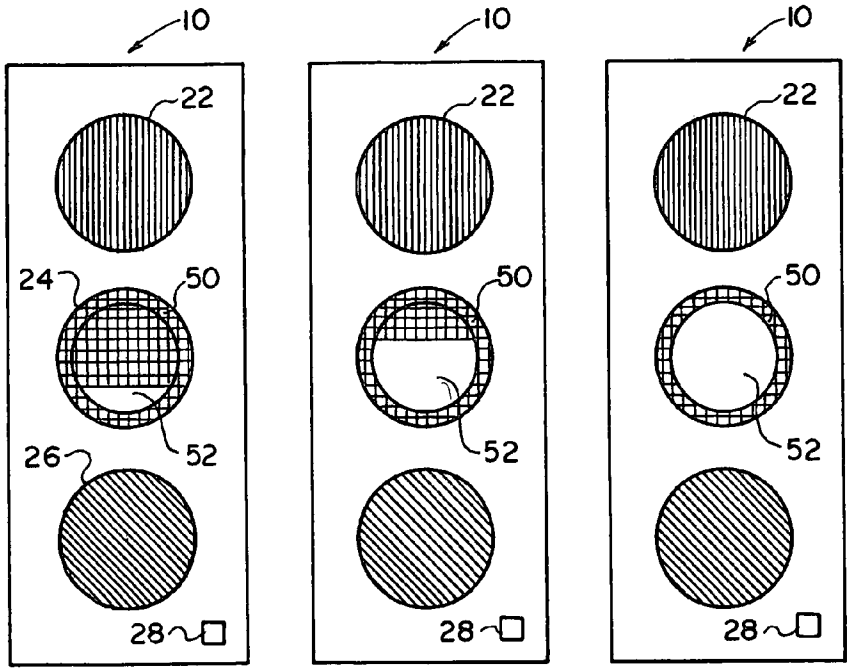
FIGS. 8*a* through 8*c* are diagrammatic views illustrating countdown sequence of illuminating a circular light indicator of a traffic light device, with the no-light zone expanding in a vertical direction.

Turning now to the embodiment of FIGS. 8*a* through 8*c*, the yellow light indicator 24 is shown having a circular configuration. A normally-illuminated outer band defines the outer periphery of the circle. The zone of the diminishing illumination 52 can be seen expanding in a vertical direction, from a lower part of the circle towards the upper part thereof. Expansion of the no-light zone 52 shown in FIG. 8*b* leads to the majority area of the portion 52 being non-illuminated, as shown in FIG. 8*c*. This patter of the light indicator 24 signals to the public that the "caution" cycle has finished and the red light will switch momentarily.

Figure 9:
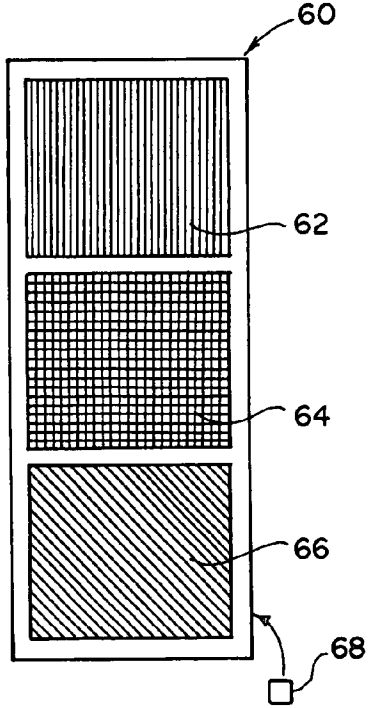
FIG. 9 is a schematic view of a traffic light device having a common illumination means, with portions of the illumination means being programmed to flash different colors.

FIGS. 7 and 9 show still another embodiment of the present invention based on the same principle of the expanding no-light zone of a traffic light indicator. Some of the traffic lights are formed as single LEDs, with different parts of the lens being programmed to flash the desired color, being it red, yellow or green. Such traffic lights may come in the rectangular form shown in FIG. 9. In such cases, the present invention provides for pattern of illumination that can expand in a horizontal or vertical fashion within a rectangular frame. FIG. 9 schematically illustrates traffic light 60 having rectangular portions 62, 64, and 66 for red, yellow and green light indication, respectively. A control means 68, which can be a microprocessor, control operation of the traffic light device 60 and switching of the colors.

As shown in FIGS. 7*a* through 7*e*, a rectangular light indicator 64 has a normally illuminated yellow border 70. The central portion 72 is programmed to expand the no-light zone moving in a horizontal or vertical fashion. As the non-illuminated zone 72 expands, the area occupied by the illuminated part 74 decreases until such time as the center of the light indicator 64 is not illuminated, as shown in FIG. 7*e*. Still, with the frame 70 retaining the yellow color, the public knows that the yellow light indicator controls the traffic. If desired, an optional intermediate light band 76 can be provided within the area 72 to warn the public that the red light is about to be switched on.

As will be appreciated by those skilled in the art, any of the indicator lights 22, 24, 26 or 62, 64, 66 can be programmed to exhibit different lighting patterns. The green lights 26, 66 may be designed to demonstrate the gradually diminishing illuminated areas so as to better warn the public of the time remaining before the "caution" light is switched on. Similarly, the red lights 22, 62 with the diminishing light pattern may be programmed to alert the public that the light will change to green momentarily and the public should proceed in the allowed direction without delay. The light pattern can be pre-programmed into the controls means 28, 68 controlling light elements, for instance LED light elements of the light indicators 22, 24, 26, 62, 64, and 66.

The traffic light device of the present invention does not require additional supports or structures. The remaining time indicators are built-in into the traffic structure proper, with the control means 28, 68 reacting to the changing traffic patterns by switching the diminishing light patterns from one light indicator to another. In this way, the public is always aware, which of the traffic light indicators is being counted down. If desired, the control means may be programmed to use the diminishing light zone pattern only with yellow light.

The same design of controlling illumination of a light indicator can be used for regulating a single-light traffic device. In such a case, the control means is programmed to gradually reduce illumination of the light indicator portions to indicate either the time remaining before passage is allowed, or conversely, before passage through the passageway will be closed.

The microprocessor 28 can be powered by the same power source, which controls operation of the traffic light, or may be powered by a back-up battery, or by solar power.

Many other changes and modifications can be made in the design of the present invention without departing from the spirit thereof. We, therefore, pray that our rights to the present invention be limited only by the scope of the appended claims.

We claim:

1. A traffic light device, comprising:

a signal structure having a circular red stop light indicator, a circular green passage light indicator, and a circular yellow caution light indicator; and a count down indicator means coupled to at least one circular light indicator for pictorially displaying through a diminishing illumination of portions of said at least one circular light indicator the time remaining until traffic light changes, which is conducted in accordance with a pre-selected pattern, wherein said at least one circular light indicator has a circumference and a discreet area, and wherein the pre-selected pattern includes a plurality of segments defined within the discreet area of the circular light indicator, and wherein the controls means control sequential extinguishing of illumination in an increasing number of segments.

2. The device of claim 1, wherein a last to be illuminated segment is provided with an arc having a color corresponding to a color of the next to be illuminated traffic light.

3. A traffic light device, comprising:

a signal structure having a circular red stop light indicator, a circular green passage light indicator, and a circular yellow caution light indicator; and a count down indicator means coupled to at least one circular light indicator for pictorially displaying through a diminishing illumination of portions of said at least one circular light indicator the time remaining until traffic light changes, which is conducted in accordance with a pre-selected pattern, wherein the pre-selected pattern includes a normally-illuminated outer band formed about the circumference of the circular light indicator and a zone of diminishing illumination defined between said outer band and a center of the circular light indicator.

4. The device of claim 3, wherein the zone of diminishing illumination is programmable to increase starting from the outer band and expanding towards the center of the circular light indicator.

5. The device of claim 4, wherein the pre-selected pattern includes a normally-illuminated center portion and an outer band defined between the center portion and outer circumference, said outer band being programmable to change color from a first color corresponding to a current cycle of the traffic light operation to a second color corresponding to the next cycle of the traffic light operation.

6. The device of claim 3, wherein the zone of diminishing illumination is programmable to increase in a non-radial pattern.

7. A traffic light device, comprising:

a signal structure having a circular red stop light indicator, a circular green passage light indicator, and a circular yellow caution light indicator; and a count down indicator means coupled to any or all selected of the circular light indicators for pictorially displaying through a diminishing illumination of portions of said any or all selected of the circular light indicators the time remaining until traffic light changes, wherein diminishing illumination of portions of said any or all selected of the circular light indicators is conducted in accordance with a pre-selected pattern, and wherein the pre-selected pattern includes a normally-illuminated center portion and an outer band defined between the center portion and outer circumference, said outer band being divided into two parts, one part of which is normally illuminated, and the second part of which forms a pattern of diminishing light illumination.

8. A traffic light device, comprising:

a signal structure having a circular red stop light indicator, a circular green passage light indicator, and a circular yellow caution light indicator; and a count down indicator means coupled to at least one circular light indicator for pictorially displaying through a diminishing illumination of portions of said at least one circular light indicator the time remaining until traffic light changes, said count down indicator means comprising a microprocessor for generating and controlling a pattern of illumination of said at least one light indicator, wherein the pre-selected pattern includes a plurality of segments defined by the area of the circular light indicator, and wherein the pre-selected pattern further includes diminishing number of illuminated segments expanding in a clockwise direction.

9. A traffic light device, comprising:

a signal structure having a circular red stop light indicator, a circular green passage light indicator, and a circular yellow caution light indicator; and a count down indicator means coupled to at least one circular light indicator for pictorially displaying through a diminishing illumination of portions of said at least one circular light indicator the time remaining until traffic light changes, said count down indicator means comprising a microprocessor for generating and controlling a pattern of illumination of said at least one light indicator, wherein the pre-selected pattern includes a normally-illuminated outer band formed about the circumference of the circular light indicator and a portion of diminishing illumination defined between said outer band and a center of the circular light indicator.

10. The device of claim 9, wherein the portion of diminishing illumination is programmable to increase starting from the outer band and expanding towards the center of the circular light indicator.

11. A traffic light device, comprising:

a signal structure having a circular red stop light indicator, a circular green passage light indicator, and a circular yellow caution light indicator; and a count down indicator means coupled to at least one circular light indicator for pictorially displaying through a diminishing illumination of portions of said at least one circular light indicator the time remaining until traffic light changes, said count down indicator means comprising a microprocessor for generating and controlling a pattern of illumination of said at least one light indicator, wherein the pre-selected pattern includes a normally-illuminated center portion and an outer band defined between the center portion and outer circumference, said outer band being programmable to change color from a first color corresponding to a current cycle of the traffic light operation to a second color corresponding to the next cycle of the traffic light operation.

12. A method of controlling a traffic flow, comprising the steps of:

providing a traffic light structure having a red stop light indicator, a green passage light indicator, and a yellow caution light indicator; and providing a count down indicator means coupled to at least one light indicator for pictorially displaying through a diminishing illumination of portions of said at least one light indicator the time remaining until traffic light changes;

programming a selected display pattern of diminishing illumination for said at least one light indicator; and causing said at least one light indicator follow the selected pattern by gradually expanding a zone of extinguished illumination within said at least one light indicator, thereby warning the public of the time remaining until traffic light changes.

13. The method of claim 12, further comprising a step of programming a display pattern by dividing the area of the indicator light into a plurality of segments and then causing an increasing number pf segments to become non-illuminated.

14. The method of claim 12, wherein the pre-selected pattern includes a step of forming a normally-illuminated outer band about the outer periphery of said at least one light indicator and defining a portion of diminishing illumination between said outer band and a center of said at least one light indicator.

15. The method of claim 14, wherein the portion of diminishing illumination is programmed to increase starting from the outer band and expanding towards the center of the circular light indicator.

16. The method of claim 12, wherein the step of forming the selected pattern includes a step of defining a normally-illuminated center portion and an outer band defined between the center portion and outer circumference, said outer band being programmable to change color from a first color corresponding to a current cycle of the traffic light operation to a second color corresponding to the next cycle of the traffic light operation.

17. The method of claim 12, wherein said at least one light indicator includes a yellow color indicator.

18. The method of claim 12, wherein said at least one light indicator has a circular configuration.

19. The method of claim 12, wherein said at least one light indicator has a rectangular configuration.

* * * * *